United States Patent [19]

Deberry

[11] Patent Number: 5,046,639

[45] Date of Patent: Sep. 10, 1991

[54] FLARE DISPENSER

[75] Inventor: Daniel L. Deberry, West Sacramento, Calif.

[73] Assignee: American Security & Technology, Inc., Davis, Calif.

[21] Appl. No.: 487,103

[22] Filed: Mar. 2, 1990

[51] Int. Cl.[5] ..... B65G 59/00

[52] U.S. Cl. ..... 221/127; 221/131; 221/194; 312/45

[58] Field of Search ..... 221/127, 124, 131, 307, 221/309, 310, 123, 191, 194, 289, 60.1, 123; 312/72, 73, 45

[56] References Cited

U.S. PATENT DOCUMENTS

| | | | |
|---|---|---|---|
| 1,017,856 | 2/1912 | Dobes | 221/194 |
| 1,340,748 | 5/1920 | Bono | 221/194 |
| 1,379,228 | 5/1921 | Swift | 221/310 |
| 1,950,805 | 3/1934 | Marsh | 312/45 |
| 3,127,177 | 3/1964 | Benkoe | 221/194 |
| 4,775,077 | 10/1988 | Capotorto | 221/131 |

FOREIGN PATENT DOCUMENTS

| | | | |
|---|---|---|---|
| 14401 | of 1912 | United Kingdom | 221/131 |

*Primary Examiner*—Robert P. Olszewski
*Assistant Examiner*—Kenneth Noland
*Attorney, Agent, or Firm*—Mark C. Jacobs

[57] ABSTRACT

A flare carrier and dispenser for the safe and convenient transportation of a plurality of flares. The flares are stacked vertically in two spaced inclined columns within a housing and are dispensable on command by the depression of a spring-loaded gate disposed at the bottom of each column of flares.

14 Claims, 2 Drawing Sheets

FLARE DISPENSER

BACKGROUND OF THE INVENTION

Policemen, highway patrols, firemen, and other emergency situation personnel, even long distance truck drivers have a need to use a large number of flares, usually 10 to 12 or even more to warn moving traffic vehicles of an accident or source of possible danger in an area. If a highway patrolman or state policeman removes a large quantity of flares from the trunk of his or her vehicle for disposition upon the highway, such a deed requires two hands. It is not possible to light any one flare without putting all of the other flares down every few feet, when two hands are needed to light a flare to be placed at a particular location. Indeed with 6 flares in one's hand, it is difficult to close the trunk and lock it with one hand, while the other retains the flares.

There is a need therefore for a container for the easy transportation of a plurality of flares from the emergency vehicle to the site of impending danger.

There is a need to be able to easily and quickly light each of the flares carried within the container.

Since each emergency is different, there is a need for a carrier container for flares, that permits the single unit dispensing of flares on an as needed basis.

Other objects of the invention will in part be obvious and will in part appear hereinafter.

The invention accordingly comprises the product possessing the features, properties and the relation of components which are exemplified in the following detailed disclosure and the scope of the application of which will be indicated in the claims.

KNOWN PRIOR ART

A search of the prior art was carried out in the U.S. Patent Office. The following U.S. Pat. Nos. are known to applicant:

| | |
|---|---|
| 4,664,291 | Gunderson |
| 4,789,081 | Mobbs |
| 3,219,244 | Blask |
| 0,926,581 | Lewis |
| 0,319,322 | Roberts |
| 0,254,530 | Armstrong |

It is applicant's belief that the invention disclosed and claimed in this application is not disclosed in any of these references, nor is it obvious from any plurality of same.

For a fuller understanding of the nature and objects of the invention, reference should be had to the following detailed description taken in conjunction with the accompanying drawings.

SUMMARY OF THE INVENTION

A flare container that both carries and dispenses flares one at a time, and as such is designated a flare dispenser. The flares are stacked in oppositely canted spaced vertical rows in two storage sections within a housing. Access to each storage section is by a spring biased bottom wall or door. The doors may be contoured to receive and retain one flare therein after the delivery thereof.

DESCRIPTION OF THE PREFERRED EMBODIMENT

Figure 1:
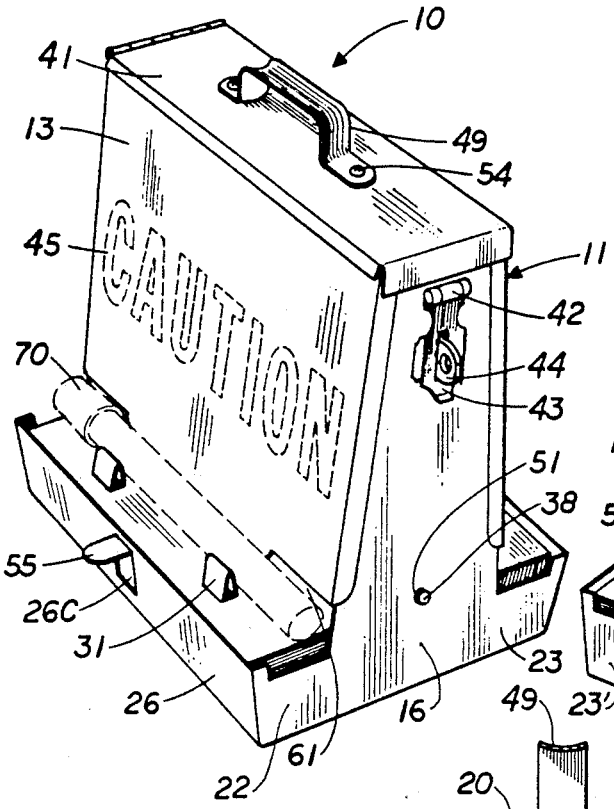
FIG. 1 is right side perspective view of the apparatus of this invention.
Figure 2:
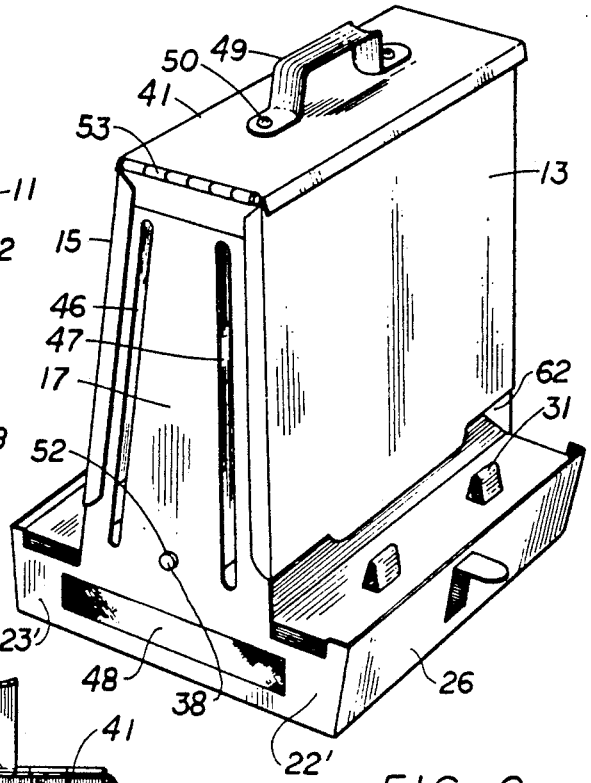
FIG. 2 is a left side perspective view thereof.

In FIG. 1 there is seen the apparatus in perspective from the right side, while in FIG. 2, the opposite or left side thereof is seen. Apparatus 10 includes a housing 11 having two storage sections 12, 14, therein designated (A) and (B). The two storage sections are best seen by reference to FIG. 3.

Storage section (A) is seen to be bounded by front wall 13 of the housing 11 which is spaced from interior wall 18; while storage section (B) is bounded by rear wall 15 spaced from interior wall 19. Both storage sections share the two side walls 17 (FIG. 2) and 16 (FIG. 1). The two interior walls 18 and 19 are welded or otherwise attached to the side walls 17 and 16 at a right angle. The two interior walls both terminate at their upper ends at opposite edges of top interior wall 20, per FIG. 3. Obviously walls 18, 19 and 20 can be formed as an integral unit with proper bends. The spacing between walls 13, 18 and 19, 15 is preferably about 1.5 inches to accommodate conventional road flares. Each storage section is closed off at the bottom by a pair of spring biased doors 27, 28, to be discussed in more detail infra with respect to the discussion of FIG. 6. Each storage section has an open top 60, 60' for loading of flares 70. See FIG. 5.

Each of the two side walls 16 and 17 each include a pair of oppositely outward extending portions which on the right side wall 16 are designated 22 and 23, while on the left side wall these portions are designated 22' and 23'. Front and rear lower walls 26 and 26' per FIGS. 1 and 2 are each respectively normally disposed to and extend from the leading edges of each of outward extending portions 22, 22' and 23, 23'. These lower walls 26, 26' may depend slightly downwardly and inwardly. Each lower wall includes a central cutout 26C, 26C' which aligns with the disposition of the release portions 54 and 55 of the respective doors, to permit the downward movement of the doors, since as shown the release portions 55, 54 preferably extend beyond the front lower walls. See FIG. 3.

Figure 7:
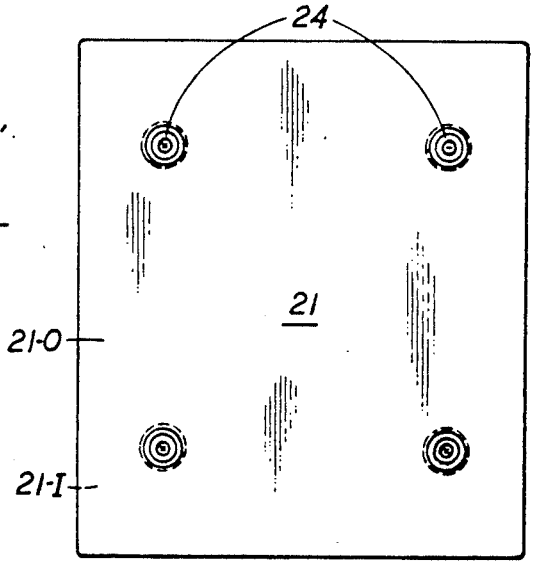
FIG. 7 is a bottom plan view of the apparatus of this invention.

The reader is referred momentarily to FIG. 7 where there is seen a single bottom wall 21 disposed normal to the lower edge of each of the two spaced side walls 17 and 16. Each of the front and rear lower walls 26 and 26' also terminate at the bottom wall 21. Spaced rubber feet 24 are conventionally secured as by sheet metal screws at suitable locations on the outer surface 21-O of the bottom wall 21. The springs 25, 25' are attached on the inner surface 21-I of the bottom wall 21 and are therefore seen drawn in dashed line in this FIG. 7.

Lid 41 is seen to overlie the two storage sections of the housing 11 as per FIGS. 1 and 2. Lid 41 is attached by a conventional piano hinge 53 or other suitable hinging mechanism as seen in FIG. 2. The lid 41 is seen to preferably include downwardly curved edges that overly each of the front and rear walls 13 and 15 respectively as well as the side wall opposite the hinge mount. Needless to say the lid can be pivotally mounted on either of the two side walls 16, 17 interchangeably. Lid 41 as shown includes an optional carrying handle 49, which is conventionally secured as by sheet metal screws 50, or by welding.

Figure 4:
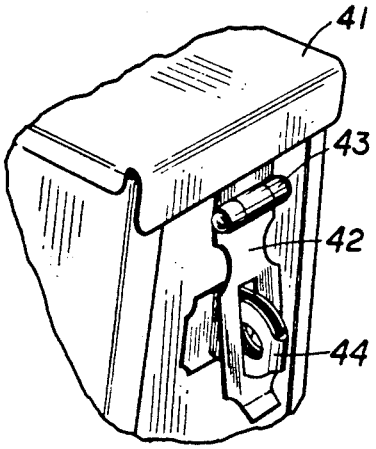
FIG. 4 is a close-up perspective view of a portion of this invention.

Hasp 42 best seen in FIG. 4 is seen to include a conventional pivoting hinge portion 43 which may be mounted to lid 41 at either the curved edge facing the side wall as seen in FIG. 4, or on the upper surface of lid 41. Either mount is deemed conventional. See also FIG. 5. The fixed or padlock receiving section 44 of the hasp 42 is mounted on the side wall opposite the hinge mechanism of lid 41 at location that permits cooperation thereof with section 43. Since such hasps are deemed conventional, further discussion is unnecessary.

Figure 3:
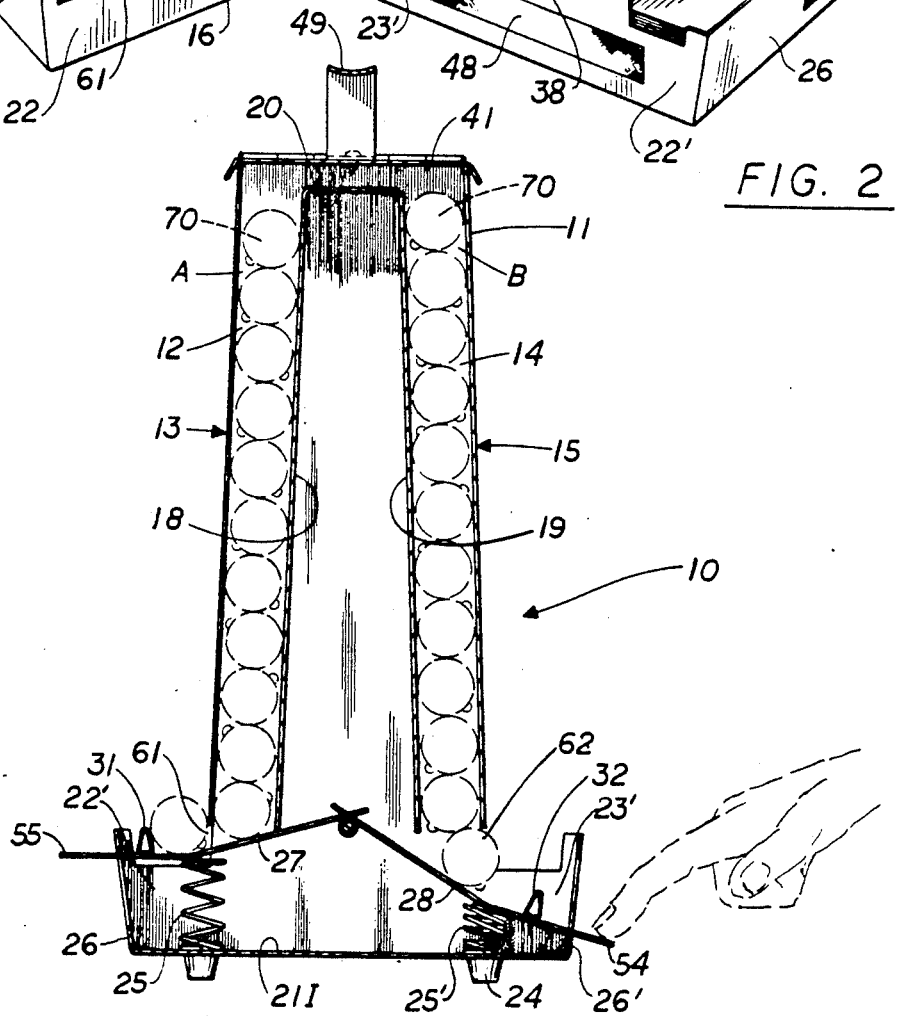
FIG. 3 is an elevational section view of the flare dispenser of this invention.
Figure 6:
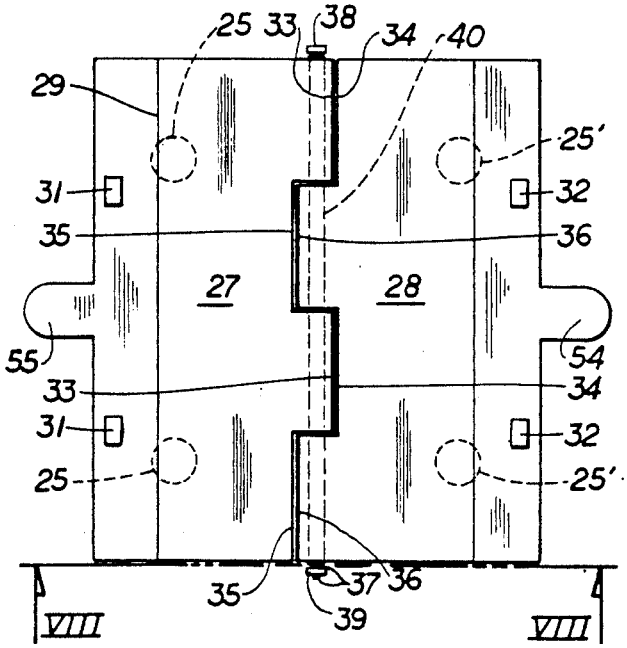
FIG. 6 is a top plan view of the spring biased doors employed in this invention.
Figure 8:
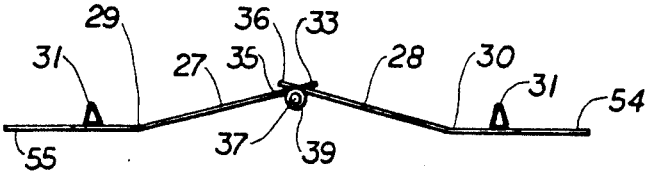
FIG. 8 is an end view of elements of FIG. 6, taken along the line VI—VI.

The discussion now turns to FIGS. 3, 6 and 8 concerning the spring biased doors 27 and 28. The relative disposition of these two doors at lower end of each of the two storage sections 12 and 14 is shown in FIG. 3. As elements unto themselves, they are best seen in FIG. 6. Left door 27 and right door 28 are each generally rectangular sections as seen from above, and each has a plurality of recesses 35 and 34 respectively that matingly receive spaced correspondingly sized forward extensions 33 and 36. Here one pair of each of said extensions and recesses are shown, but 3 or 4 or even more such pairs can be employed as may be desired.

Mounted on the underside of each of the 4 forward extensions shown, as by welding, is a tubular channel section 40 for receiving a pivot pin 37. Each of the 4 tubular sections 40 is axially aligned and each is disposed spaced slightly rearwardly from the leading edge of the forward extension as can be seen in FIG. 6, as well as in FIG. 8.

It is noted that other constructions can be utilized to create means for the reception of the pivot pin, 37, such as a folding under of the leading edge of each forward extension to form a built-in channel for the pivot pin. Such a construction is found in door hinges and is contemplated for use herein as well.

Pivot pin 37 has a head 38 and is retained in position as by a conventional retainer such as a nut 39 disposed on threads at the end opposite the head, which threads are not seen. The location of the pivot pin and nut are seen in FIGS. 1 and 2 wherein the pivot pin is seen to be inserted through a first bore 51 in the side wall 16 per FIG. 1 and exits out a second bore 52 for attachment of the nut 39 in side wall 17.

Each door 27, 28 preferably includes a longitudinal downward crease 29, 30 as shown in FIGS. 6 and 8. The relative disposition of the upper end of each of the coil springs 25, 25' which may be attached to the underside of the doors 27 and 28 are shown in dotted line. The lower ends of each of these coil springs 25, 25' as has been previously mentioned, is secured as by welding or adhesing to the inner surface of the bottom wall 21 as per FIG. 7. While coil springs are shown in the drawings, obviously the use of leaf springs is contemplated herein as well. Each door also includes an outward extending release portion 55 and 54. Such release portions are disposed on the edge opposite the forward extensions and recesses 33–36 discussed supra.

While the flares 70 upon dispensing will fall upon the door through the slot created upon the biasing downward of the particular door by pushing down on release portions 54 or 55, it is preferred to employ optional upstanding retainers 31, 32 shown in FIGS. 1 and 2 to be mounted at spaced locations outwardly of the creases 29 and 30 to prevent the flares from rolling off the door after egress from the particular storage section. See FIG. 5. The slots referred to above are designated 61 and 62 and are sized in elevation to permit egress of the flare from its respective storage section. See FIGS. 1, 2, and 3.

Reference should again be made to FIG. 2. As can be clearly seen here and in FIG. 1, indicia 45, such as the word CAUTION, may be applied as by painting or by a decal to indicate to oncoming vehicles the need for caution. Or, if desired the name of the entity owning the apparatus of this invention can be located thereupon; e.g. MY-TOWN FIRE DEPT. to prevent theft.

"Sight glasses" 46, 47 may optionally be employed to provide information on the number of flares currently in each storage section at any point in time. These sight glasses may be mere ¼ slots in one or both side walls, or preferably such slots are covered over by clear plastic sheet such as acrylic, to prevent inadvertent access to the storage sections. The attachment of such plastic material is deemed to be within the skill of the art.

An optional striker pad 48 can be installed at some convenient location for the lighting of the flares. Here it is shown disposed horizontally along one of the side walls. It may be mounted here, on the opposite side wall or at any other location deemed convenient such as the outer surface of the lid 41 if desired.

OPERATION

Figure 5:
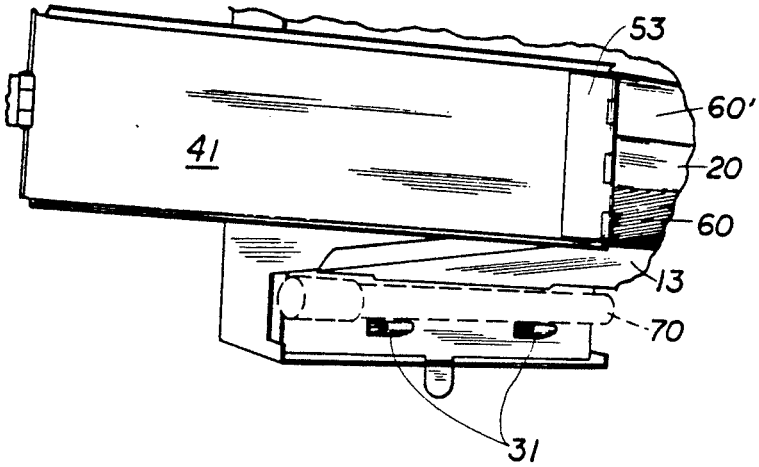
FIG. 5 is a top perspective view of another portion of this invention.

The loading of the flares 70 into the apparatus of this invention is carried out by first undoing the hasp 42 and opening the lid 41 to the position shown in FIG. 5. Flares are loaded into the two storage sections (A) and (B) through openings 60, 60' per FIG. 5. Any number of flares may be so stored depending upon the elevation of the storage sections. Here ten flares 70 are shown in each storage section as per FIG. 3.

When the release portions are urged downwardly by pressure of the user's fingers the balance of the door is biased downwardly thereby creating a slot such as 61 for a single flare 70 to exit through, which slot is located between the bottom edge of each of the outer front and rear walls of the housing and the respective door. The operation of each of the two doors is independent and as such all of the flares may be removed from one storage section and none from the other or they can be removed alternatively as may be desired. The latter mode is preferable for even weight distribution for the carrying of the apparatus after one or more flares have been removed.

After the release portion of the door has been urged downwardly, one flare is removed due to the gravitational flow downward thereof. It rolls from its retained position in the storage sections 12 or 14 through the slot to the crease and stops there. The retainer such as 31 prevents the flare from rolling off the door. Upon removal of pressure on the release portion, such as 54, its respective door moves to its normal closed position due to the removal of tension on the coil springs 25' therebeneath, to thus close off the egress slot 61.

While the lid 41 has been shown to be retained by a hinge on one end and a hasp on the other, obviously it is contemplated that the lid can also be removably attached in some other fashion, just so that access can be had to each of the storage sections within the housing.

It is also to be noted that the front and rear walls may be vertical or canted slightly downwardly and outwardly as shown in the drawings for a more aesthetic appeal and for easier movement of the flares out the slot.

It is seen that I have provided a unique carrying means for road flares that permits their disposition one at a time upon command. The apparatus of this invention may be made of steel, aluminum or other metal or of any suitable plastic, or a combination thereof.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A road flare dispenser apparatus comprising:

a. a housing having spaced generally vertical outer front and rear walls, each of which has a bottom edge, spaced side walls disposed normal to the front and rear walls, and a pair of generally vertical interior walls spaced from each other and spaced from the front and rear walls to thereby form a pair of storage sections within the housing;

b. a pair of downwardly openable independently operable interconnected spring biased doors, each of which in a first position closes off one of the storage sections, and when moved to a second position permits the egress of a flare from within the respective storage section through a slot temporarily formed between the bottom edge of the respective outer wall and the respective door of said storage section;

c. a bottom wall on said housing, said doors being springingly connected to said bottom wall;

wherein each of said spaced side walls includes a pair of oppositely outward extending portions to which front and rear lower walls are each respectively normally disposed to and extend from; as well as a pair of oppositely outward extending portions to which front and rear lower walls are each respectively normally disposed to and extend from; each of said front and rear lower walls having a central cutout therein which cutouts adapted to receive a means to effectuate the manual actuation of said doors.

2. The road flare dispenser apparatus of claim 1 wherein the vertical interior walls are connected at the top at opposite ends of a horizontally disposed wall.

3. The road flare apparatus of claim 1 wherein the bottom wall extends the expanse between the opposite outwardly extending portions, and rubber feet are mounted on said bottom wall.

4. The road flare dispenser of claim 1 further including d. an openable lid attached to a wall of said housing.

5. The road flare apparatus of claim 4 wherein the lid is hingedly attached to a side wall and attached by a hasp to the other of said side walls.

6. The road flare dispenser of claim 5 wherein a handle is mounted on said lid.

7. The road flare apparatus of claim 1 wherein indicia is printed on at least one of said front and rear walls.

8. The road flare apparatus of claim 1 wherein each of said doors includes a longitudinal crease therein.

9. The road flare apparatus of claim 8 wherein at least one retainer is mounted on each of said doors adjacent its respective crease.

10. The road flare apparatus of claim 1 wherein said doors are pivotally attached to each of said side walls.

11. A road flare dispenser apparatus comprising:

a. a housing having spaced generally vertical outer front and rear walls, each of which has a bottom edge, spaced side walls disposed normal to the front and rear walls, and a pair of generally vertical interior walls spaced from each other and spaced from the front and rear walls to thereby form a pair of storage sections within the housing:

said vertical interior walls being connected at the top at opposite ends of a horizontally disposed wall;

b. a pair of downwardly openable independently operable interconnected spring biased doors, each of which in a first position closes off one of the storage sections, and when moved to a second position permits the egress of a flare from within the respective storage section through a slot temporarily formed between the bottom edge of the respective outer wall and the respective door of said storage section;

c. a bottom wall on said housing, said doors being springingly connected to said bottom wall and pivotally mounted to said side walls;

wherein each of said spaced side walls includes a pair of oppositely outward extending portions to which front and rear lower walls are each respectively normally disposed to and extend from, each of said front and rear lower walls having a central recess therein adapted to receive a projecting member to effectuate the opening of said doors the said bottom wall extends between said front and rear lower walls.

12. The road flare apparatus of claim 11 wherein the lid is hingedly attached to a side wall and attached by a hasp to the other of said side walls and a handle is mounted on said lid to facilitate carrying.

13. The road flare apparatus of claim 11 wherein each of said doors includes a longitudinal crease therein and wherein at least one retainer is mounted on each of said doors adjacent its respective crease.

14. The road flare apparatus of claim 11 wherein each door has an outwardly extending release portion disposed to align with the central cutout of the lower wall for vertical movement of said release portion.

* * * * *